US007338540B1

(12) United States Patent
Babcock et al.

(10) Patent No.: US 7,338,540 B1
(45) Date of Patent: Mar. 4, 2008

(54) DECOMPOSITION OF ORGANIC AZIDES

(75) Inventors: Jason R. Babcock, Topanga, CA (US); Arthur J. Fortini, Pasadena, CA (US)

(73) Assignee: Ultramet Incorporated, Pacoima, CA (US)

( * ) Notice: Subject to any disclaimer, the term of this patent is extended or adjusted under 35 U.S.C. 154(b) by 304 days.

(21) Appl. No.: 10/634,640

(22) Filed: Aug. 5, 2003

Related U.S. Application Data

(60) Provisional application No. 60/401,499, filed on Aug. 6, 2002.

(51) Int. Cl.
*C01L 1/22* (2006.01)

(52) U.S. Cl. ..... 44/354; 44/357; 44/419; 44/457; 149/109.2; 149/109.4; 149/115; 149/122

(58) Field of Classification Search ..... 149/109.2, 149/109.4, 115, 122; 44/354, 357, 419, 457
See application file for complete search history.

(56) References Cited

U.S. PATENT DOCUMENTS 3,066,479 A * 12/1962 Koch, Jr. ..... 60/212
3,741,585 A * 6/1973 Hendrickson et al. ..... 280/741
3,865,660 A * 2/1975 Lundstrom ..... 149/35
4,124,538 A 11/1978 Armstrong et al.
4,132,780 A * 1/1979 McConnell ..... 424/600
4,157,648 A * 6/1979 Brennan et al. ..... 60/205
5,457,265 A * 10/1995 Heubner et al. ..... 588/318
5,552,257 A * 9/1996 Stewart et al. ..... 430/201
6,210,504 B1 * 4/2001 Thompson ..... 149/1
6,299,654 B1 * 10/2001 Thompson ..... 44/265

OTHER PUBLICATIONS

Coleman et al., Acid catalysis in the decomposition of benzazide, Apr. 22, 2001, Journal of the American Chemical Society (1954), 76 4534-8.*
Coleman, et al.; *Acid Catalysis in the Decomposition of Benzazide*; Journal of the American Chemical Society; vol. 76, pp. 4534-4538; (Sept. 20, 1954).

* cited by examiner

*Primary Examiner*—Cephia D. Toomer
(74) *Attorney, Agent, or Firm*—Christie, Parker & Hale, LLP

(57) ABSTRACT

A method of decomposing an organic azide is provided and comprises allowing an organic azide to contact a catalytic metal halide, main group halide, mixed metal-main group halide, or mixture thereof. Organic azide fuel sources comprising an organic azide/catalyst combination are also provided.

18 Claims, No Drawings

DECOMPOSITION OF ORGANIC AZIDES

CROSS-REFERENCE TO RELATED APPLICATION(S)

This application claims the benefit of U.S. Provisional Application No. 60/401,499, filed Aug. 6, 2002, the entire contents of which are incorporated by reference herein.

STATEMENT REGARDING FEDERALLY SPONSORED RESEARCH OR DEVELOPMENT

The invention described herein was made in the performance of work under an Army Phase I SBIR contract (DAAH01-C—R097) and is subject to the applicable provisions of the United States Code.

FIELD OF THE INVENTION

This invention relates to the catalytic decomposition of organic azides, for example, 2-dimethylaminoethyl azide.

BACKGROUND OF THE INVENTION

Hydrazine, monomethyl hydrazine, hydrazinium nitrate, and mixtures thereof have been used, and continue to be used, as monopropellants for rocket engines, gas generators, auxiliary power units (APUs), tank pressurization systems, and other applications. These compounds and mixtures can be catalytically decomposed to produce hot, gaseous products which can then be used to produce thrust, drive a turbine, or otherwise perform work. The advantages of hydrazine and hydrazine derivatives include high performance, fast response time when used with a suitable catalyst, and a well-established record of performance. Furthermore, the decomposition of hydrazine takes place at moderate temperatures (<700° C.), and the decomposition products ($N_2$, $H_2$, and $NH_3$) are not oxidizing. This allows one to use steel and/or nickel-based alloys for the combustion chamber; expensive and exotic materials such as niobium alloys or rhenium are not needed.

Despite their widespread use, hydrazine and hydrazine derivatives are not without drawbacks. Hydrazine, for example, is classified by the Department of Transportation (DOT) as a flammable liquid, a poison, and a corrosive material. It is also carcinogenic and listed in the Environmental Protection Agency's (EPA's) Toxic Substances Control Act (TSCA) inventory. For these reasons, there has been a long-felt need in the chemical propulsion industry for a less-hazardous replacement for hydrazine.

The catalyst most frequently used for decomposition of hydrazine and its derivatives is Shell-405, which is described in U.S. Pat. No. 4,124,538, the entire contents of which is incorporated by reference herein. Shell-405 utilizes highly dispersed iridium on a high-surface area, aluminum oxide support. In a typical satellite propulsion application, the catalyst bed is heated to approximately 200° C. prior to introducing the propellant. Failure to preheat the catalyst decreases the life of the catalyst bed by increasing the severity of the thermal shock experienced by the catalyst due to the large amount of heat released during propellant decomposition. The result of repeated thermal-shock cycles is mechanical attrition of the catalyst granules and expulsion of fines from the bed. Despite the undesirable effects of "cold starts," the catalyst is capable of decomposing hydrazine at temperatures as low as 2° C., the freezing point of hydrazine. For hydrazine blends with lower freezing points, the catalyst still has sufficient activity to allow cold starts. This capability is useful in satellite applications, as it makes the system usable in the event of failure of the catalyst bed heater.

In the search for a less-hazardous substitute for hydrazine and hydrazine derivatives, the U.S. Army Space and Missile Command identified 2-dimethylaminoethyl azide (also known as DMAZ or CINCH fuel), an organic-azide compound, as a candidate replacement. DMAZ is non-carcinogenic and only one-tenth as toxic as hydrazine. It has a calculated thruster performance comparable to that of hydrazine, and an adiabatic flame temperature slightly less than that of hydrazine. This combination of features make DMAZ attractive as a replacement for hydrazine in virtually all of hydrazine's current applications, including auxiliary power units, emergency power units (EPUs), monopropellant and bipropellant thrusters, tank pressurization systems, and gas generators.

The primary challenge to the use of DMAZ as a hydrazine replacement is the difficulty in catalyzing its decomposition. Shell-405, for example, requires temperatures in the 175-200° C. range to cause rapid decomposition. Although heating the catalyst bed to improve its performance and response time is generally acceptable to the chemical-propulsion and aerospace communities, the mandatory use of such high temperatures is not. A catalyst that requires above-ambient temperatures needs heaters and the associated electronics to power and control said heaters. The resulting system is inherently more complex and prone to significantly diminished reliability.

Azide Chemistry

Organic azides ($R—N_3$) with low molecular weight R groups are notorious for being unpredictably explosive, and their stability is generally increased as the size of the R group increases. More specifically, as the R group becomes more electron-donating, the C—N bond strength—and hence, the stability of the molecule—increases. Consequently, one approach to decomposing organic azides is to use a catalyst that will destabilize the C—N bond by withdrawing electron density from the area. For example, a strong Lewis acid (i.e., a strong electron pair acceptor) will attract electron lone pairs on nitrogen atoms within the azide molecule. The terminal nitrogen is likely the most basic, and thus most likely to be attracted to the Lewis acid. Attraction of one or more of any of the nitrogen atoms will cause the net result of a large withdrawal of electron density from the C—N bond. This will facilitate the first step in the proposed decomposition mechanism cleavage of this C—N bond. Thus, researchers have reported that "Organic azides are sensitized by . . . traces of strong acids."

$$R—N{=}N^{-}{=}N^{+}$$

Organic Azide

Examples of strong, solid-state Lewis acids include alumina ($Al_2O_3$), titania ($TiO_2$), tin oxide ($SnO_2$), and zeolites. It should be noted, however, that strong Lewis acids and/or sulfated zirconia ($ZrO_2$) superacid may not be sufficient to decompose DMAZ, and additional energy input may be required. Indeed, it has been shown that ZSM-5 zeolite and $ZrO_2$ superacid do not decompose DMAZ at room temperature. Additional energy, additional destabilization of the molecule, or stabilization of the reaction products is required. Because many azides, both organic and inorganic, are shock-sensitive, the additional energy can be in the form of mechanical energy associated with flow of the propellant through the system.

Another approach to decomposing an organic azide is to reverse the common synthesis reaction and decompose the resulting azide. The most common method of preparing organic azides is the $S_N2$ reaction of an organohalide with sodium azide in a polar solvent such a methanol:

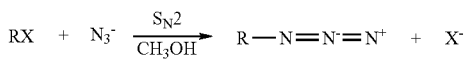

Thus, in the presence of halids (e.g. NaBr), a small portion of the R—$N_3$ molecules will undergo the reverse reaction to form $N_3^-$ where the $N_3^-$ is coordinated to the sodium. Sodium azide is known to react violently with several materials, such as copper, lead, and barium carbonate. Thus, a finely dispersed admixture of NaCl and $BaCO_3$ on a high surface area support has the potential of decomposing organic azides. Researchers have also reported that "Organic azides are sensitized by metal salts." As a specific example, azidoacetic acid ($C_2H_3N_3O_2$) in contact with iron or iron salts is said to undergo rapid exothermic decomposition at 25° C.

The other method of organic azide synthesis involves the reaction of the monosubstituted hydrazine (RNH—$NH_2$) with nitrous acid ($HNO_2$):

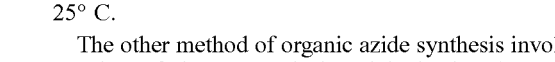

It is tempting to use the same approach as above and add small amounts of water to the propellant to generate the monosubstituted hydrazine. The monosubstituted hydrazine could then be decomposed over a more conventional catalyst such as Shell-405. As it turns out, however, most azides are not water-reactive, and the amount of hydrazine formed would be inconsequential. Blasting caps use lead azide because it is particularly stable in wet environments. This lack of reactivity is both good and bad. It is bad in the sense that the simple ignition scheme described above will not work, but it is good in that the addition of water (which will boost the performance as described later) will not form toxic compounds.

The laboratory method of organic azide decomposition makes use of lithium aluminum hydride, and the resulting product is the amine:

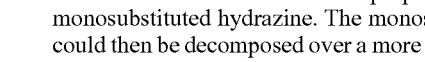

This reaction proceeds readily, and great care must be taken to prevent thermal run-away. Note that, in this sequence, the $LiAlH_4$ is consumed, and is therefore not a catalyst per se. It demonstrates, however, that the presence of a hydrogen-donating compound will greatly facilitate the reaction of the azide.

SUMMARY OF THE INVENTION

The present invention provides a method of decomposing an organic azide in which an organic azide is allowed to contact a catalyst that comprises a metal halide, a main group halide, a mixed metal-main group halide, or a mixture thereof. The invention also provides a fuel source for producing thrust or otherwise performing work, comprising an organic azide in combination with an organic azide decomposition catalyst.

The catalyst can be used in its pure form as granules, in conjunction with other catalytically active materials (to increase the overall rate or extent of reaction), in conjunction with chemically reactive materials (to increase the rate of reaction or to prevent residue from accumulating on the catalyst), or in conjunction with inert materials (to decrease the rate of reaction). In each of these cases, the catalyst or catalyst combination is used with or without a support.

The invention allows the rapid and spontaneous decomposition of organic azides, for example, 2-dimethylaminoethyl azide (DMAZ), even at temperatures as low as −30° C. This is particularly advantageous in satellites and other space-borne applications where the ambient temperature is very low and where a defective heater cannot be repaired. The use of heaters, of course, will allow operation at higher catalyst temperatures, higher DMAZ temperatures, or both, and will increase the rate of reaction; but such heaters are not required.

The inherent reliability of the catalyst in the event of a heater failure is of great benefit in aircraft APUs and EPUs. The systems are often called into play when an engine needs to be restarted while the aircraft is in flight; i.e., where reliability is of great importance.

DETAILED DESCRIPTION OF THE INVENTION

According to one aspect of the invention, a method of decomposing an organic azide comprises allowing an organic azide to contact a catalyst comprising a metal halide, main group halide, mixed metal-main group halide, or mixture thereof. In another aspect of the invention, an organic azide fuel source comprises an organic azide in combination with a catalyst comprising a metal halide, main group halide, mixed metal-main group halide, or mixture thereof.

Although the invention is not confined to use with any particular organic azide, it is particularly preferred for use in decomposing organic azides having the general formula (I)

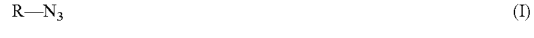

(I)

where R is an organic group selected from the group consisting of alkyl, alkyl amino, nitrogen-containing heterocyclic-substituted alkyl (that is, an alkyl group substituted with at least one nitrogen-containing heterocycle), and alkyl amine substituted with at least one alkyl azide group.

Nonlimiting examples of alkyl groups include methyl, ethyl, propyl, butyl, and isomers (iso-, sec-, tert-, etc.) thereof.

Nonlimiting examples of alkyl amino groups include dimethylamino, diethylamino, dipropylamino, dibutylamino, and isomers thereof, as well as "mixed" alkyl amino groups, e.g., N-methyl, N-ethylamino; N-propyl, N-butylamino; etc.; and isomers thereof.

Nonlimiting examples of nitrogen-containing heterocyclic-substituted alkyl groups include alkyl groups substituted with pyrrollidine, imidazole, pyrrole, piperidine, pyrroline, pyrazole, piperazine, or 1,2,4-triazole.

When R is an "alkyl amine substituted with at least one alkyl azide group" the organic azide (I) has the formula $R^1NH(R^2N_3)$ or $R^1N(R^2N_3)(R_3N_3)$, where $R_1$, $R_2$, and $R_3$ are each, independently, an alkyl group as described above. A nonlimiting example of such a compound is bis(ethylazide) methylamine.

It will be appreciated that the organic azides referred to herein have, in each case, a carbon atom bound directly to one of the nitrogen atoms of the azide ($N_3$) group. Hence, in some cases, it may be more appropriate to refer to the alkyl groups as "alkylenyl" groups.

In one embodiment of the invention, the catalyst is a transition metal halide. Transition metals that can exist in more than one formal oxidation state and can form multiple halides (e.g., $FeCl_3$ and $FeCl_2$) are preferred. The higher oxidation states are preferred (e.g., $FeCl_3$ is preferred over $FeCl_2$).

The catalyst preferably has a melting point above the flame temperature of the azide that is to be decomposed, which is approximately 900° C. for DMAZ. For supported catalysts where the catalytic material is dispersed within the pores of the support, it is not necessary for the melting point of the catalyst to be greater than that of the propellant's adiabatic flame temperature, although the melting point of the support should be greater than the adiabatic flame temperature if long-term use is required.

Melting of the catalyst clusters within the pores will not result in physical loss of catalyst except possibly through evaporation; however, loss of catalytic surface area may result from coalescence of the clusters. Melting of the catalyst will make the catalyst more resistant to poisoning and fouling since the detrimental specie(s) will dissolve into the bulk material and not remain on the surface.

Anhydrous $FeCl_3$ rapidly catalyzes the decomposition of DMAZ, even when both the catalyst and DMAZ are at −30° C. This has been demonstrated on granular $FeCl_3$ (assay 98%) obtained from Alfa Aesar (Ward Hill, Mass.) with no additional purification or processing. Because the surface area of the $FeCl_3$ granules was measured to be only 0.29 $m^2/g$, the reactivity per unit surface area is very high.

The primary drawbacks of $FeCl_3$ are its low melting point and low decomposition temperature, but steps can be taken to mitigate their effects. $FeCl_3$ boils and decomposes at 315° C.; however, the observed boiling is actually the evolution of $Cl_2$ as the $FeCl_3$ decomposes to $FeCl_2$, which is also catalytically active. $FeCl_2$ is reported to melt at 672° C. and boil at 1023° C. Thus, a heated sample of $FeCl_3$ will melt at 306° C. and begin decomposing to $Cl_2$ and solid $FeCl_2$ at 315° C. Further heating of the $FeCl_2$ will result in melting at 672° C. and boiling at 1023° C.

$FeCl_2$ is also catalytically active, and fast decomposition of DMAZ has been demonstrated at 80° C. Consequently, decomposition of $FeCl_3$ to $FeCl_2$ during use will not significantly compromise the catalyst's ability to decompose DMAZ. However, if the introduction of DMAZ to the catalyst bed is terminated and the bed allowed to cool, reheating of the bed to 80° C. will be required for subsequent reuse.

In addition to pure compounds such as $FeCl_3$, main group halides and mixed metal-main group halides (e.g., ternary compounds), as well as mixtures thereof, can alternatively be used. For example, coinfiltrated $FeCl_3$ and $PCl_5$ can be used as a mixture, or the two compounds can be chemically combined to form $FePCl_8$. Similarly, CuCl can be used with $FeCl_3$ or chemically combined to form $Fe_2Cu_2Cl_8$. In addition to ternary compounds, compounds with more than two cationic elements can alternatively be used. The resulting ternary or higher-order compound can be used by itself or as a mixture with other catalytic compounds. Other transition metal and/or main group cations besides copper and phosphorus can alternatively be used.

In addition to the option of using a catalyst having two or more different cations, the catalyst can contain two or more different anions. A nonlimiting example is $FeCl_2Br$.

For propulsion or gas-generator applications where the organic azide is used in a flow-through system, steps must be taken to prevent molten catalyst from flowing out of the bed. In one embodiment of the invention, this is accomplished by using a porous, sinter-resistant support with a suitably high melting point, e.g. $\gamma$-$Al_2O_3$, activated carbon, porous $ZrO_2$, etc. In such applications, the supported catalyst granules are typically captivated between two screens or other porous supports, which allow fluid to flow through, but which prevent granules from leaving the bed.

To impregnate the porous support with $FeCl_3$, several approaches can be taken. The $FeCl_3$ can be dissolved in a suitable, anhydrous solvent, such as diethyl ether, alcohol, or acetone. The support material is then exposed to the solution and dried. As is the case with other catalysts, multiple impregnation steps with dilute solutions provide deeper penetration of the material into small pores.

If it is anticipated that the catalyst will be used under conditions with sufficient duration to make melting of the $FeCl_3$ unavoidable, the $FeCl_3$ can be vacuum cast into the porous support. In this method, the support granules are mixed with a sufficient amount of $FeCl_3$ heated under vacuum to 150° C. to remove adsorbed water from the support and to dry the catalytic material. Heating is continued under a $Cl_2$ atmosphere until the $FeCl_3$ melts and wicks into the pores.

While this procedure does not result in the same high surface area as the solvent approach, many applications do not require high surface area. Transient response testing in a pino test apparatus has demonstrated the ability of even low-surface area, ambient-temperature granules of unsupported $FeCl_3$ to raise the temperature of cold (−30° C.) propellant to 376° C. in 0.037 s. The primary function of the support in this instance is not to increase the available catalytic surface area, but rather to prevent the molten catalyst from flowing through the screen and out of the bed.

Because DMAZ contains carbon atoms but no oxygen, and because the flame temperature is above the point where hydrocarbons break down to produce solid carbon, it is expected that DMAZ, over the course of time, will leave behind a carbon residue on the catalyst. The extent to which carbon will be deposited depends on several variables, including the propellant flow rate and pulse sequence, the local bed temperature, the bed geometry, granule size and pore size distribution of the support, and the overall catalyst surface area.

At 900° C. and 220 psia in a pure methane environment, carbon deposits at a reported rate of $8.3\times10^{-9}$ g $cm^{-2}\cdot s^{-1}$. Assuming the decomposition pathway of DMAZ includes C—N bond cleavage and recombination of the unsaturated hydrocarbon species, one would expect the primary carbon-bearing species to be $C_2H_4$ and $C_2H_6$. A gas generator operating at 100 psi would thus be expected to produce an environment with a 25 psia partial pressure of $C_2H_4$, 25 psia of $C_2H_6$, and 50 psia of $N_2$ in the immediate vicinity of the catalyst bed. Under these conditions and 800° C., the combined carbon deposition rate from both species is predicted to be $3.2\times10^{-9}$ g $cm^2\cdot s^{-1}$. Even at this low rate, 1 hour of operation would result in a carbon coating thickness of 0.058 μm, which is sufficient to foul a typical catalyst. But for a catalyst that liquefies and remains within the pores of a support, the deposited carbon will, to a certain extent, dissolve into the liquid, thus regenerating the catalyst surface and maintaining its catalytic activity.

The active catalytic material can be used in its pure state as granules or in conjunction with other compounds or elements, which may also be catalysts. The catalyst, with or without said other compounds or elements, can be dispersed on or otherwise in contact with a support, or may be free-standing.

EXAMPLES

In the examples that follow it is assumed that 2-dimethylaminoethyl azide is the organic azide being decomposed. Other organic azides can also be used, and the mention of 2-dimethylaminoethyl azide is not intended to limit the applicability of the invention.

Example 1

An organic azide is allowed to contact anhydrous iron (III) chloride, $FeCl_3$, which is optionally used in a granular form without a support. Specifically, 1.3 g of $FeCl_3$, pre-cooled to −29° C. then added to a sample of 0.5 ml organic azide that had been pre-cooled to −32° C., exhibited an energetic decomposition of the azide following a 32.8 ms delay, raising the catalyst/azide temperature to 255° C. Because of its low melting point, such a catalyst bed is suitable for use as a single-start gas-generator or propulsion system. For systems requiring multiple restart capability, the catalyst described in Example 3 would be more suitable.

Example 2

Anhydrous iron (II) chloride, $FeCl_2$, optionally in a granular form without a support, is used as the catalyst. Because $FeCl_2$ has a higher light-off temperature, as well as a higher melting point, a catalyst bed of this material, when used in a rocket propulsion application, would need to be heated to temperatures in excess of 50° C., and preferably in excess of 80° C., prior to propellant introduction.

Example 3

Anhydrous iron (III) chloride, $FeCl_3$, is dispersed on a high-surface area, granular support. Such a catalyst bed would be useful for a gas generator tank pressurization system requiring multiple, short-duration pulses. If the catalyst material reaches a sufficient temperature, the $FeCl_3$ will decompose to $FeCl_2$, and the catalyst bed can be used as described in Example 4.

Example 4

Anhydrous iron (II) chloride, $FeCl_2$, is dispersed on a high-surface area, granular support. Such a bed would need to be heated to temperatures in excess of 50° C., preferably in excess of 80° C., prior to introducing the propellant. By operating at temperatures and pressures where the $FeCl_2$ is in the liquid state, poisoning and/or fouling by residual carbon is minimized.

Example 5

Anhydrous iron (III) chloride, $FeCl_3$, is dispersed on a high-surface area, granular support and the resulting granules mixed with another catalyst that has better high-temperature stability, but which also requires higher temperatures to ignite the propellant (e.g. aluminum oxide granules containing highly dispersed iridium). Such a bed can be used for long-duration, single start applications such as missile propulsion. The $FeCl_3$ initiates the reaction, and though it will melt and ultimately be lost to evaporation, the second catalyst can maintain the combustion process.

The invention has been described and illustrated by exemplary and preferred embodiments, but is not limited thereto. Persons skilled in the art will appreciate that a variety of modifications can be made without departing from the scope of the invention, which is limited only by the appended claims and equivalents thereof.

What is claimed is:

1. A method of decomposing an organic azide, comprising:

allowing an organic azide to contact a catalyst that comprises a transition metal halide, wherein the organic azide has the formula R—$N_3$, where R is an organic group selected from the group consisting of alkyl, alkyl amino, nitrogen-containing heterocyclic-substituted alkyl, and alkyl amine substituted with at least one alkyl azide group.

2. A method as recited in claim 1, wherein the transition metal in the transition metal halide can have one or more formal oxidation states.

3. A method as recited in claim 1, wherein the transition metal in the transition metal halide is present in its highest formal oxidation state.

4. A method of decomposing an organic azide, comprising:

allowing an organic azide to contact a catalyst that comprises an iron halide or a mixture of iron halide and a second catalyst, wherein the organic azide has the formula R—$N_3$, where R is an organic group selected from the group consisting of alkyl, alkyl amino, nitrogen-containing heterocyclic-substituted alkyl, and alkyl amine substituted with at least one alkyl azide group.

5. A method of decomposing an organic azide, comprising:

allowing an organic azide to contact a catalyst that comprises a transition metal chloride, wherein the organic azide has the formula R—$N_3$, where R is an organic group selected from the group consisting of alkyl, alkyl amino, nitrogen-containing heterocyclic-substituted alkyl, and alkyl amine substituted with at least one alkyl azide group.

6. A method as recited in claim 5, wherein the transition metal chloride comprises iron (III) chloride, iron (II) chloride, or a combination of iron (III) chloride and iron (II) chloride.

7. A method of decomposing an organic azide, comprising:

allowing an organic azide to contact a catalyst that comprises an iron chloride in combination with a second catalyst, wherein the organic azide has the formula R—$N_3$, where R is an organic group selected from the group consisting of alkyl, alkyl amino, nitrogen-containing heterocyclic-substituted alkyl, and alkyl amine substituted with at least one alkyl azide group.

8. A method of decomposing an organic azide, comprising:

allowing an organic azide to contact a catalyst that comprises a metal halide, main group halide, mixed metal-main group halide, or mixture thereof, wherein the organic azide has the formula R—$N_3$, where R is an organic group selected from the group consisting of alkyl, alkyl amino, nitrogen-containing heterocyclic-substituted alkyl, and alkyl amine substituted with at least one alkyl azide group, and wherein the catalyst is dispersed on a support.

9. A method as recited in claim 8, wherein the support comprises a second organic azide decomposition catalyst.

10. A composition of matter comprising:

(a) an organic azide having the formula R—$N_3$, where R is an organic group selected from the group consisting of alkyl, alkyl amino, nitrogen-containing heterocyclic-substituted alkyl, and alkyl amine substituted with at least one alkyl azide group; and (b) a catalyst capable of decomposing the organic azide, said catalyst comprising a transition metal halide.

11. A composition of matter as recited in claim 10, wherein the transition metal in the transition metal halide can have one or more formal oxidation states.

12. A composition of matter as recited in claim 10, wherein the transition metal in the transition metal halide is present in its highest formal oxidation state.

13. A composition of matter comprising:

(a) an organic azide having the formula R—$N_3$, where R is an organic group selected from the group consisting of alkyl, alkyl amino, nitrogen-containing heterocyclic-substituted alkyl, and alkyl amine substituted with at least one alkyl azide group; and (b) a catalyst capable of decomposing the organic azide, said catalyst comprising an iron halide or a mixture of iron halide and a second catalyst.

14. A composition of matter comprising:

(a) an organic azide having the formula R—$N_3$, where R is an organic group selected from the group consisting of alkyl, alkyl amino, nitrogen-containing heterocyclic-substituted alkyl, and alkyl amine substituted with at least one alkyl azide group; and (b) a catalyst capable of decomposing the organic azide, said catalyst comprising a transition metal chloride.

15. A composition of matter as recited in claim 14, wherein the transition metal chloride comprises iron (III) chloride, iron (II) chloride, or a combination of iron (III) chloride and iron (II) chloride.

16. A composition of matter comprising:

(a) an organic azide having the formula R—$N_3$, where R is an organic group selected from the group consisting of alkyl, alkyl amino, nitrogen-containing heterocyclic-substituted alkyl, and alkyl amine substituted with at least one alkyl azide group; and (b) a catalyst capable of decomposing the organic azide, said catalyst comprising an iron chloride in combination with a second catalyst.

17. A composition of matter comprising:

(a) an organic azide having the formula R—$N_3$, where R is an organic group selected from the group consisting of alkyl, alkyl amino, nitrogen-containing heterocyclic-substituted alkyl, and alkyl amine substituted with at least one alkyl azide group; and (b) a catalyst capable of decomposing the organic azide, said catalyst comprising at least one metal halide, main group halide, mixed metal-main group halide, or mixture thereof; and wherein the catalyst is dispersed on a support.

18. A composition of matter as recited in claim 17, wherein the support comprises a second organic azide decomposition catalyst.

* * * * *